US006170160B1

(12) United States Patent
Freige

(10) Patent No.: US 6,170,160 B1
(45) Date of Patent: Jan. 9, 2001

(54) BAKED POTATO OPENER

(76) Inventor: Diab Edmond Freige, 99 Doud Dr., Los Altos, CA (US) 94022

( * ) Notice: Under 35 U.S.C. 154(b), the term of this patent shall be extended for 0 days.

(21) Appl. No.: 09/364,608

(22) Filed: Jul. 30, 1999

(51) Int. Cl.[7] ..... B26B 3/00
(52) U.S. Cl. ..... 30/294; 30/315
(58) Field of Search ..... 30/286, 294, 305, 30/315; 99/485

(56) References Cited

U.S. PATENT DOCUMENTS 2,813,335 * 11/1957 Ritter ..... 30/315 X
4,106,196 * 8/1978 Smithline ..... 30/294

* cited by examiner

*Primary Examiner*—Douglas D. Watts
(74) *Attorney, Agent, or Firm*—Jack Lo

(57) ABSTRACT

A baked potato opener is comprised of a pair of side members with connected top ends, downwardly projecting middle portions, and outwardly flared bottom ends. The side members are generally bell shaped in an end view. A cutter is connected to the top ends of the side members, and has a serrated cutting edge positioned between and slightly higher than the bottom ends of the side members. The greatest width between the side members at the bottom ends is about the same as the width of an average potato. To use, the opener is positioned on top of a potato, aligned with its longitudinal axis, and pushed downward. The top of the potato is cut by the cutter. Any aluminum foil wrapped around the potato is cleanly cut by the serrated cutting edge. The sides of the potato are engaged by the flared bottom ends of the side members. The cut is spread apart when the sides of the potato are pressed down by the bottom ends of the side members.

5 Claims, 2 Drawing Sheets

BAKED POTATO OPENER

BACKGROUND OF THE INVENTION

1. Field of the Invention

This invention relates generally to kitchen gadgets.

2. Prior Art

A baked potato is typically opened by holding it with one hand, cutting its top with a conventional knife held in another hand, putting down the knife, and spreading the cut apart by hand. Several steps are required in the process. If the potato is still wrapped in aluminum foil and the knife is not sharp enough, the foil is sometimes pushed into the potato by the knife. Further, holding and spreading an oven-hot potato by hand may be painful.

OBJECTS OF THE INVENTION

Accordingly, objects of the present baked potato opener are:

to cut the top of a potato without having the potato held by a hand;

to cut any aluminum foil wrapped around the potato without pushing it into the potato;

to spread apart the potato without having the potato held by a hand; and to cut and spread apart the potato in a single step.

Further objects of the present invention will become apparent from a consideration of the drawings and ensuing description.

BRIEF SUMMARY OF THE INVENTION

A baked potato opener is comprised of a pair of side members with connected top ends, downwardly projecting middle portions, and outwardly flared bottom ends. The side members are generally bell shaped in an end view. A cutter is connected to the top ends of the side members, and has a serrated cutting edge positioned between and slightly higher than the bottom ends of the side members. The greatest width between the side members at the bottom ends is about the same as the width of an average potato. To use, the opener is positioned on top of a potato, aligned with its longitudinal axis, and pushed downward. The top of the potato is cut by the cutter. Any aluminum foil wrapped around the potato is cleanly cut by the serrated cutting edge. The sides of the potato are engaged by the flared bottom ends of the side members. The cut is spread apart when the sides of the potato are pressed down by the bottom ends of the side members.

Figure 1:
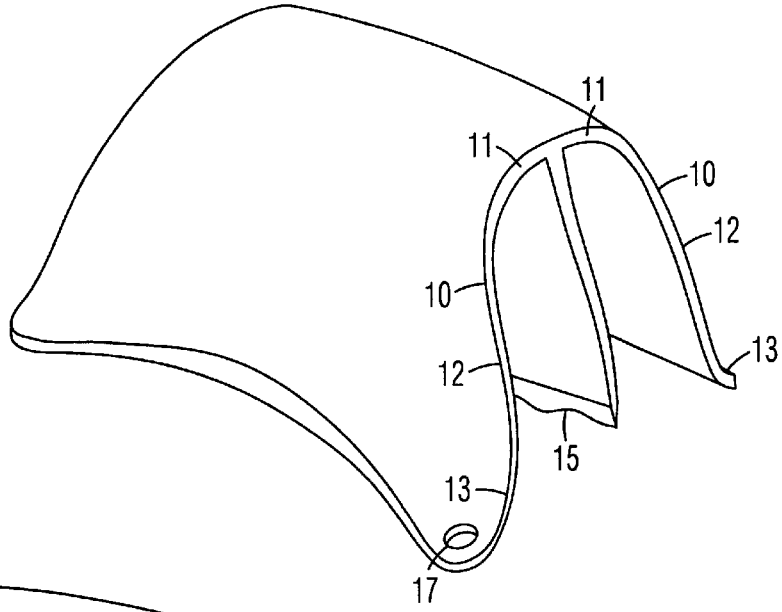
FIG. 1 is a top perspective view of the present baked potato opener.

| DRAWING REFERENCE NUMERALS | |
|---|---|
| 10. Side Members | 11. Top ends |
| 12. Middle Portions | 13. Bottom Ends |
| 14. Cutter | 15. Cutting Edge |
| 16. Sharp Point | 17. Hole |
| 18. Potato | 19. Cut |
| 20. Aluminum Foil | 21. Sides |

DETAILED DESCRIPTION OF THE INVENTION

Figure 2:
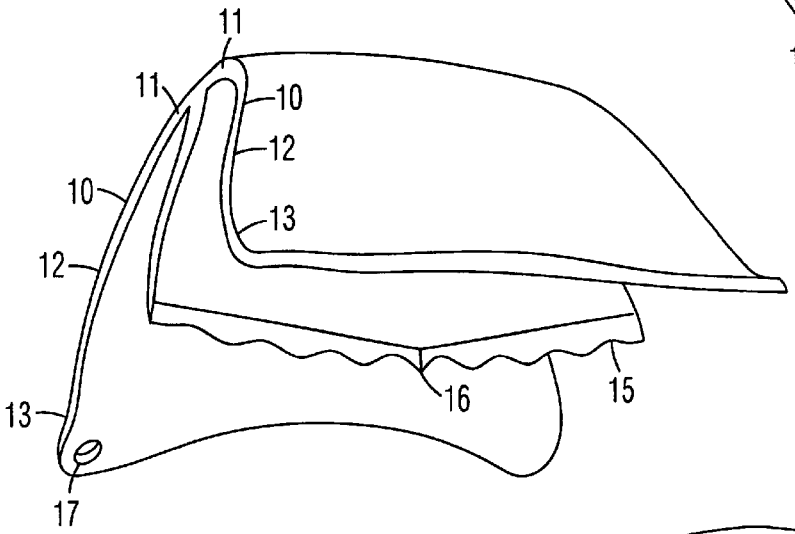
FIG. 2 is a bottom perspective view of the baked potato opener.
Figure 3:
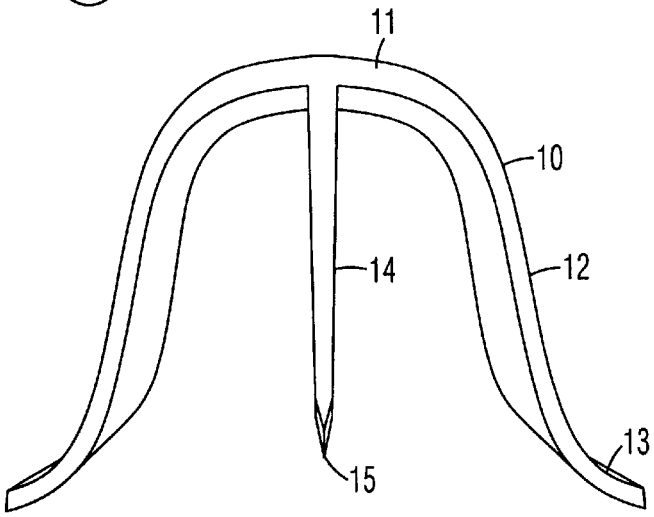
FIG. 3 is an end view of the baked potato opener.

FIGS. 1–3:

A preferred embodiment of the present baked potato opener is shown in a top perspective view in FIG. 1, a bottom perspective view in FIG. 2, and an end view in FIG. 3. It is comprised of a pair of side members 10 with connected top ends 11, downwardly projecting middle portions 12, and outwardly flared bottom ends 13. Side members 10 are generally bell shaped in an end view. Instead of being solid, top ends 11 and middle portions 12 of side members 10 may be comprised of open frames. Bottom ends 13 are preferably solid.

A cutter 14 is connected to top ends 11 of side members 10, and has a generally V-shaped (when seen in a side view) and serrated cutting edge 15 positioned between and slightly higher than bottom ends 13 of side members 10. A sharp point 16 is provided at the lowest position of cutting edge 15. The greatest width between side members 10 at bottom ends 13 is about the same as the width of an average potato. A hole 17 on one of side members 10 is used for hanging the opener on a hook.

Figure 4:
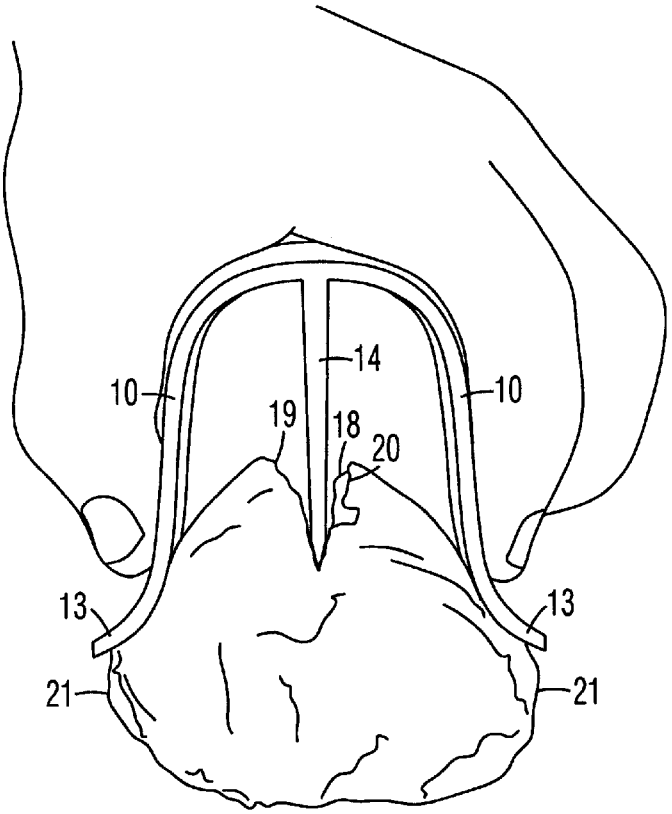
FIG. 4 is an end view of the baked potato opener in an initial moment of opening a potato.
Figure 5:
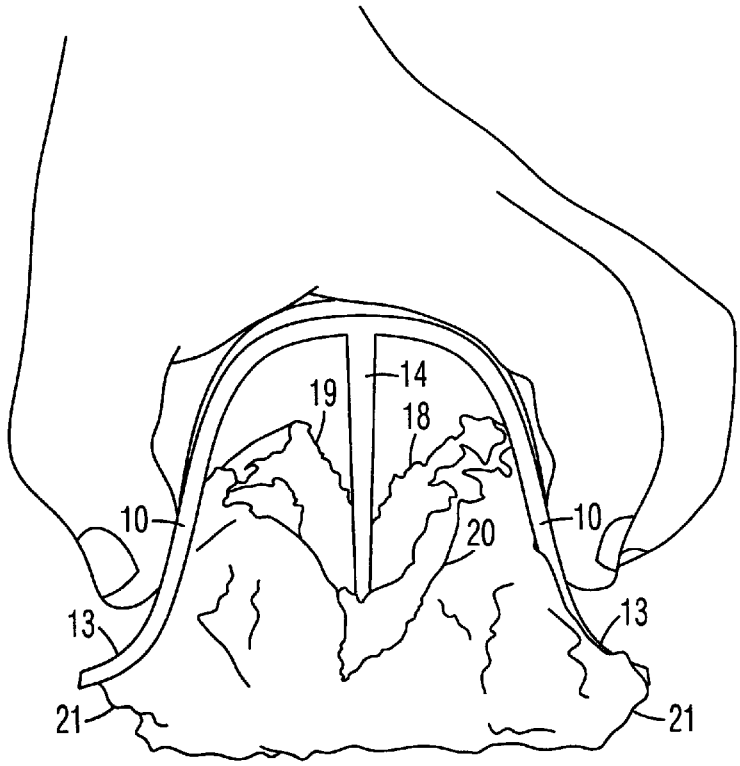
FIG. 5 is an end view of the baked potato opener in a final moment of opening the potato.

FIGS. 4–5:

The baked potato opener is shown in use in FIGS. 4–5. In FIG. 4, it is positioned on top of a potato 18 with cutter 14 aligned with its longitudinal axis, and pushed downward. A cut 19 on top of potato 18 is made by cutter 14. An aluminum foil 20 wrapped around potato 18 is easily pierced by the sharp point on the cutter, and cleanly cut by the serrated cutting edge without being pushed into potato 18. Opposite sides 21 of potato 18 are engaged by flared bottom ends 13 of side members 10. In FIG. 5, cut 19 is spread apart when sides 21 of potato 18 are pressed down by bottom ends 13 of side members 10. Cutter 14 is higher than bottom ends 13, so that potato 18 is not cut in half. Potato 18 is thus cut and spread apart in a single step, without requiring the user to directly touch its hot surface at all.

SUMMARY AND SCOPE

Accordingly, the present baked potato opener cuts the top of a potato without having the potato held by a hand. It cuts any aluminum foil wrapped around the potato without pushing it into the potato. It spreads apart the potato without having the potato held by a hand. It also cuts and spreads apart the potato in a single step.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A baked potato opener, comprising:

a pair of side members with connected top ends, downwardly projecting middle portions, and outwardly flared bottom ends, said flared bottom ends being spaced for engaging curved opposite sides of a baked potato; and a cutter positioned between said side members, said cutter having a downwardly directed cutting edge positioned higher than said flared bottom ends of said side members;

whereby when said opener is positioned on top of said baked potato, when said cutter is aligned with a longitudinal axis of said baked potato, and when said opener is pushed downward, a cut is made by said cutter on a top of said baked potato, any aluminum foil wrapped around said baked potato is cleanly cut by said serrated cutting edge without being pushed into said baked potato, said opposite sides of said baked potato being engaged by said flared bottom ends of said side members, said cut being spread apart when said opposite sides of said baked potato are pressed down by said flared bottom ends of said side members;

wherein said cutting edge is generally V-shaped in a side view, a lowest point of said cutting edge being a sharp point for positively piercing any aluminum foil wrapped around said baked potato.

2. A baked potato opener, comprising:

a pair of side members with connected top ends, downwardly projecting middle portions, and outwardly flared bottom ends, said flared bottom ends being spaced for engaging curved opposite sides of a baked potato; and a cutter positioned between said side members, said cutter having a downwardly directed cutting edge positioned higher than said flared bottom ends of said side members;

whereby when said opener is positioned on top of said baked potato, when said cutter is aligned with a longitudinal axis of said baked potato, and when said opener is pushed downward, a cut is made by said cutter on a top of said baked potato, any aluminum foil wrapped around said baked potato is cleanly cut by said serrated cutting edge without being pushed into said baked potato, said opposite sides of said baked potato being engaged by said flared bottom ends of said side members, said cut being spread apart when said opposite sides of said baked potato are pressed down by said flared bottom ends of said side members;

wherein said cutting edge is generally V-shaped in a side view, a lowest point of said cutting edge being a sharp point for positively piercing any aluminum foil wrapped around said backed potato wherein said cutting edge is comprised of a serrated cutting edge for cleanly cutting any aluminum foil wrapped around said baked potato.

3. A baked potato opener, comprising:

a pair of side members with connected top ends, downwardly projecting middle portions, and outwardly flared bottom ends, said flared bottom ends being spaced for engaging curved opposite sides of a baked potato; and a cutter positioned between said side members, said cutter having a downwardly directed cutting edge positioned higher than said flared bottom ends of said side members;

whereby when said opener is positioned on top of said baked potato, when said cutter is aligned with a longitudinal axis of said baked potato, and when said opener is pushed downward, a cut is made by said cutter on a top of said baked potato, any aluminum foil wrapped around said baked potato is cleanly cut by said serrated cutting edge without being pushed into said baked potato, said opposite sides of said baked potato being engaged by said flared bottom ends of said side members, said cut being spread apart when said opposite sides of said baked potato are pressed down by said flared bottom ends of said side members; and wherein said cutting edge is generally V-shaped in a side view, a lowest point of said cutting edge being a sharp point for positively piercing any aluminum foil wrapped around said backed potato a hole on one of said side members for engaging a supporting hook.

4. A baked potato opener, comprising:

a pair of side members with connected top ends, downwardly projecting middle portions, and outwardly flared bottom ends, said flared bottom ends being spaced for engaging curved opposite sides of a baked potato; and a cutter connected to said top ends of said side members, said cutter having a downwardly directed, generally V-shaped, and serrated cutting edge positioned between and higher than said flared bottom ends of said side members, a lowest point of said cutting edge being a sharp point;

whereby when said opener is positioned on top of said baked potato, when said cutter is aligned with a longitudinal axis of said baked potato, and when said opener is pushed downward, a cut is made by said cutter on a top of said baked potato, any aluminum foil wrapped around said baked potato is positively pierced by said sharp point and cleanly cut by said serrated cutting edge without being pushed into said baked potato, said opposite sides of said baked potato being engaged by said flared bottom ends of said side members, said cut being spread apart when said opposite sides of said baked potato are pressed down by said flared bottom ends of said side members.

5. The baked potato opener of claim 4, further including a hole on one of said side members for engaging a supporting hook.

* * * * *